US011118600B2

(12) United States Patent
Wang et al.

(10) Patent No.: US 11,118,600 B2
(45) Date of Patent: Sep. 14, 2021

(54) ANTI-PRESS FAN STRUCTURE

(71) Applicant: ASIA VITAL COMPONENTS CO., LTD., New Taipei (TW)

(72) Inventors: Te-Chung Wang, New Taipei (TW); Ming-Che Lee, New Taipei (TW); Min-Sheng Cheng, New Taipei (TW); Tien-Lung Yu, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 94 days.

(21) Appl. No.: 16/686,216

(22) Filed: Nov. 18, 2019

(65) Prior Publication Data

US 2021/0148378 A1 May 20, 2021

(51) Int. Cl.
*F04D 29/42* (2006.01)
*F04D 29/059* (2006.01)
*F04D 29/28* (2006.01)

(52) U.S. Cl.
CPC ..... *F04D 29/4226* (2013.01); *F04D 29/059* (2013.01); *F04D 29/281* (2013.01)

(58) Field of Classification Search
CPC ... F04D 29/4226; F04D 29/059; F04D 29/281
See application file for complete search history.

(56) References Cited

U.S. PATENT DOCUMENTS

2002/0122720 A1* 9/2002 Esa ..... F04D 25/045 415/159
2004/0141841 A1* 7/2004 Otsuka ..... F04D 29/542 415/220
2010/0073873 A1* 3/2010 Horng ..... H02K 9/06 361/695
2013/0323040 A1* 12/2013 Fujita ..... F04D 25/0613 415/200
2014/0127049 A1* 5/2014 Yoneda ..... H02K 5/24 417/354
2018/0003188 A1* 1/2018 Nara ..... F04D 17/16
2018/0156233 A1* 6/2018 Sawada ..... F04D 29/44
2019/0048743 A1* 2/2019 Tulej ..... F01M 11/0004
2019/0165651 A1* 5/2019 Kishi ..... H02K 5/20
2019/0305633 A1* 10/2019 Yoneda ..... H02K 7/14
2020/0072231 A1* 3/2020 Huang ..... F04D 25/0613

FOREIGN PATENT DOCUMENTS

CN 202673719 U 1/2013
CN 202867308 U 4/2013
CN 205064318 U 3/2016
CN 108425866 A 8/2018
TW M417596 U 12/2011
TW 201934889 A 9/2019

* cited by examiner

*Primary Examiner* — Michael Lebentritt
(74) *Attorney, Agent, or Firm* — Bradley J. Thorson; DeWitt LLP

(57) ABSTRACT

An anti-press fan structure includes a fan frame and a fan impeller. The fan impeller has a support shaft supporting the fan impeller disposed in the fan frame. The support shaft has a protrusion section protruding from the fan frame to bear and connect with an external unit positioned above the fan impeller so as to keep an axial space between the fan impeller and the external unit. Accordingly, the fan impeller is prevented from being compressed by the external unit and the pressure applied to the fan frame is dispersed.

10 Claims, 6 Drawing Sheets

ANTI-PRESS FAN STRUCTURE

BACKGROUND OF THE INVENTION

1. Field of the Invention

The present invention relates generally to a fan, and more particularly to an anti-press fan structure.

2. Description of the Related Art

It is known that cooling fans are widely mounted in electronic products such as desktop computer, notebook and tablet to provide heat dissipation function. Currently, it is a trend to design the notebook and the tablet with light weight and thin thickness. In order to meet the requirement of the current trend of light weight and thin thickness, the cooling fan is also designed to be a thin fan. However, when touching the panel or striking the keyboard or the product is biased or shaken, the thin fan is apt to be compressed to lead to damage of the fan impeller or deformation of the flow way. In this case, the airflow can hardly smoothly flow out.

It is therefore tried by the applicant to provide an anti-press fan structure to solve the above problem existing in the conventional cooling fan.

SUMMARY OF THE INVENTION

It is therefore a primary object of the present invention to provide an anti-press fan structure, which is able to prevent an external unit such as a keyboard, a case or a panel from compressing the fan impeller or the flow way in the fan frame.

It is a further object of the present invention to provide the above anti-press fan structure having a support shaft supporting the fan impeller disposed in the fan frame. The support shaft has a protrusion section protruding from the fan impeller and the fan frame to bear and connect with an external unit so as to keep an axial space between the external unit and the fan impeller. Accordingly, at least the fan impeller is prevented from being compressed by the external unit.

It is still a further object of the present invention to provide the above anti-press fan structure, in which at least one support column is disposed in the flow way of the fan frame to support a boss on the outer surface of the fan frame so as to keep an axial space between the external unit and the fan frame.

To achieve the above and other objects, the anti-press fan structure of the present invention includes: a fan frame having an upper case and a lower case, the upper case having a wind entrance, the lower case having a connection seat; a fan impeller having a top wall and an annular wall, the top wall having a central perforation corresponding to the wind entrance, a fan impeller bearing cup downward protruding from the top wall, multiple blades being disposed on an outer circumference of the annular wall, a magnetic member being disposed on an inner circumference of the annular wall; a roller bearing having an outer circular seat, an inner circular seat and a retainer member and multiple rolling bodies disposed between the outer circular seat and the inner circular seat, the outer circular seat being in contact with inner circumference of the fan impeller bearing cup, the inner circular seat defining a fitting hole; a support shaft having a fixed end connected with the connection seat and an extension end extending through the fitting hole of the roller bearing and the central perforation of the fan impeller to protrude from the wind entrance so as to support the fan impeller and the roller bearing disposed in the fan frame, the extension end being formed with a protrusion section protruding from the top wall of the fan impeller and the upper case of the fan frame, the protrusion section having an abutment face; a stator assembly disposed around the connection seat and correspondingly spaced from the magnetic member of the fan impeller; and a thrust member fitted on the support shaft and positioned between the roller bearing and the connection seat.

In the above anti-press fan structure, the support shaft is formed with a neck section connected with a restriction member. The restriction member is positioned above the roller bearing. The neck section and the restriction member correspond to the central perforation of the top wall of the fan impeller.

In the above anti-press fan structure, the thrust member has a first end in contact with the roller bearing and a second end in contact with the connection seat.

In the above anti-press fan structure, the fan frame has a sidewall and a lateral wind exit defined between the upper case and the lower case. A flow way is defined between the fan impeller and the lateral wind exit. The fan impeller is a centrifugal fan impeller in communication with the lateral wind exit through the flow way.

In the above anti-press fan structure, a least one support column is disposed in the flow way. The support column has two ends respectively abutting against and connecting with an inner face of the upper case and an inner face of the lower case. An upper case boss and a lower case boss are respectively disposed on an outer face of the upper case and an outer face of the lower case corresponding to two ends of the support column. The upper case boss has a top connection face flush with the abutment face of the protrusion section of the support shaft.

The abutment face of the protrusion section and the top connection face of the upper case boss bear and connect with an external unit to form an axial space between the external unit and the fan frame.

In the above anti-press fan structure, the restriction member is a C-shaped retainer ring or an O-shaped retainer ring.

In the above anti-press fan structure, the stator assembly includes a circuit board and a silicon steel sheet assembly disposed on the circuit board. The silicon steel sheet assembly has multiple stacked silicon steel sheets and a central through hole fitted around the connection seat. Multiple windings are wound on the silicon steel sheet assembly.

In the above anti-press fan structure, the thrust member is a spring.

In the above anti-press fan structure, the multiple rolling bodies of the roller bearing are selected from a group consisting of balls, needles or rollers.

In the above anti-press fan structure, a stop member is disposed in the central perforation of the top wall. The stop member horizontally extends from the top wall toward a center of the central perforation, the roller bearing abutting against the stop member.

In the above anti-press fan structure, the connection seat has a connection seat lower end face. The fixed end of the support shaft has a support shaft lower end face flush with the connection seat lower end face. The connection seat lower end face and the support shaft lower end face protrude from the lower case of the fan frame in flush with the bottom connection face of the lower case boss. The connection seat lower end face and the support shaft lower end face bear and connect with another external unit to form a second axial space between the other external unit and the lower case of the fan frame.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
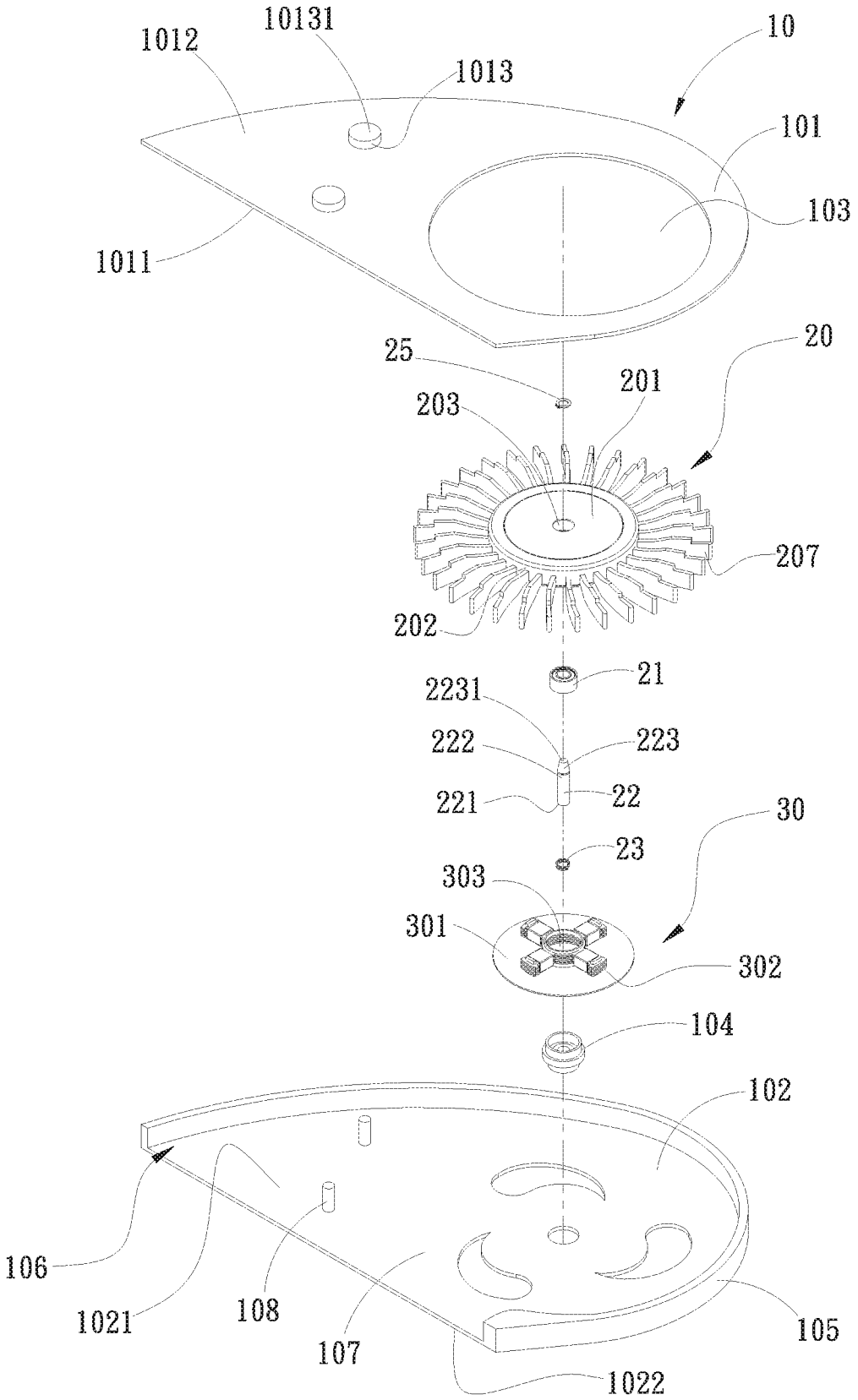
FIG. 1 is a perspective exploded view of the present invention.
Figure 2:
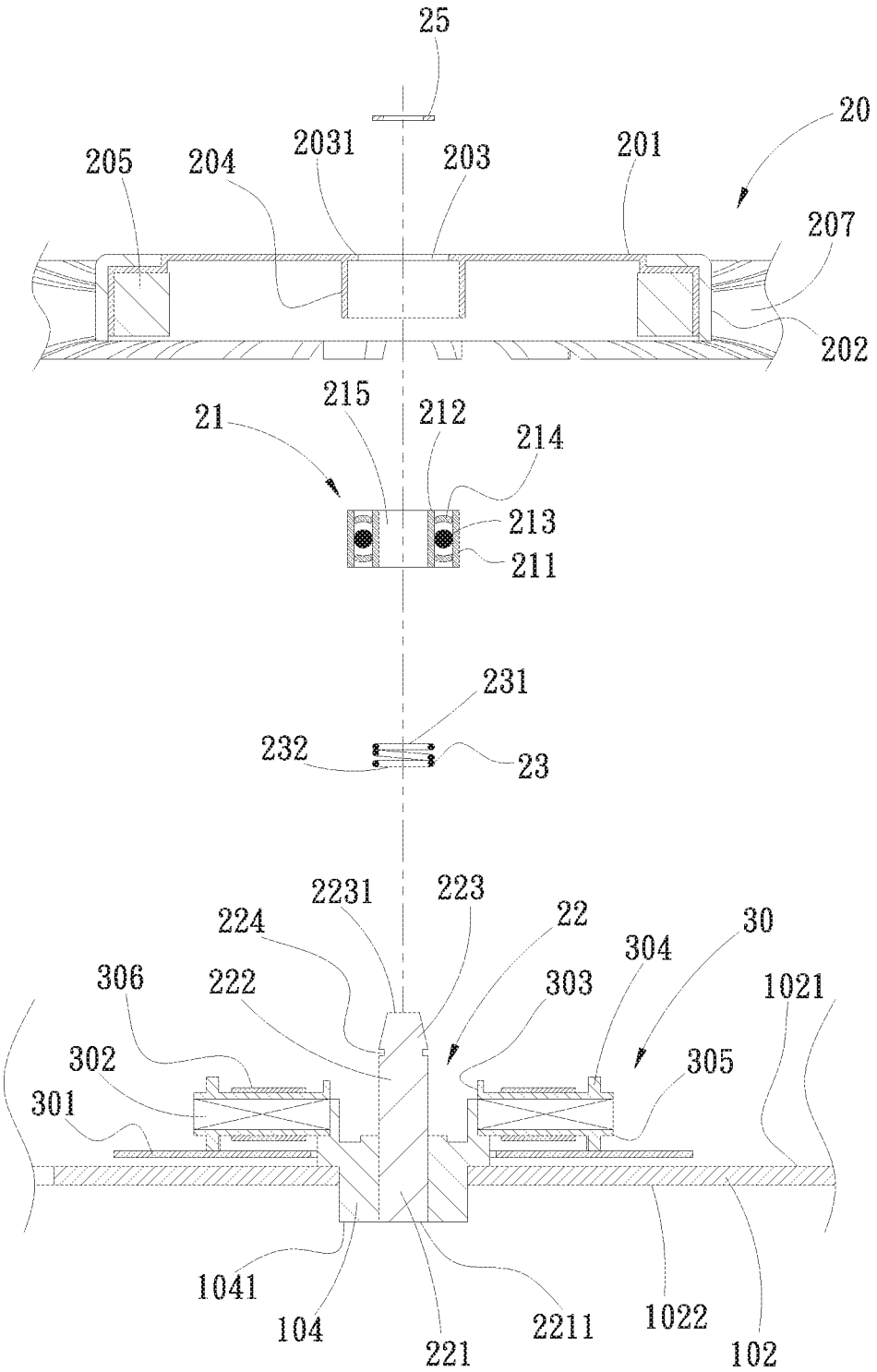
FIG. 2 is a partially exploded view of the present invention.
Figure 3:
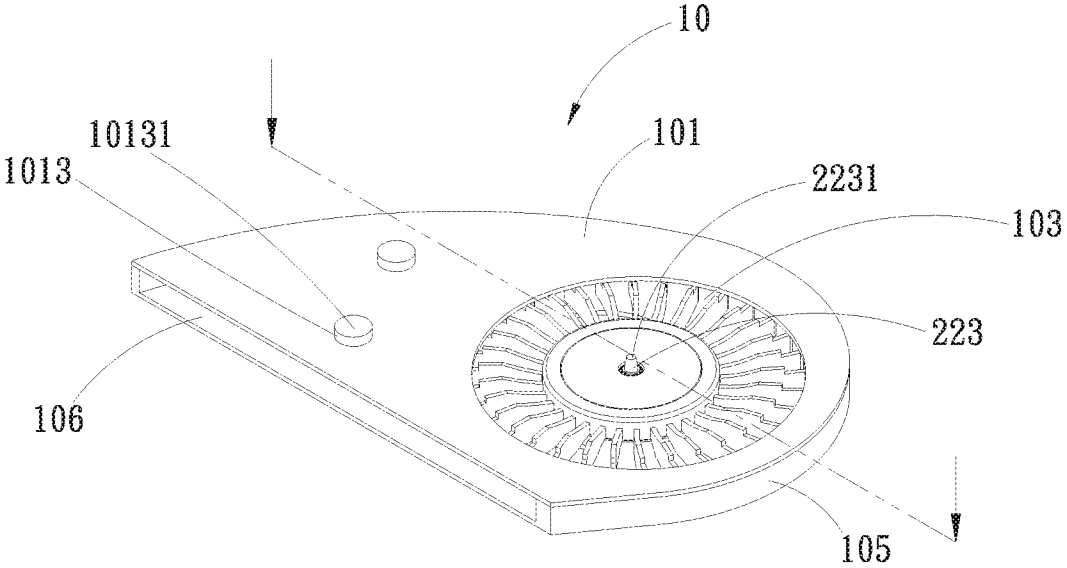
FIG. 3 is a perspective assembled view of the present invention.
Figure 4:
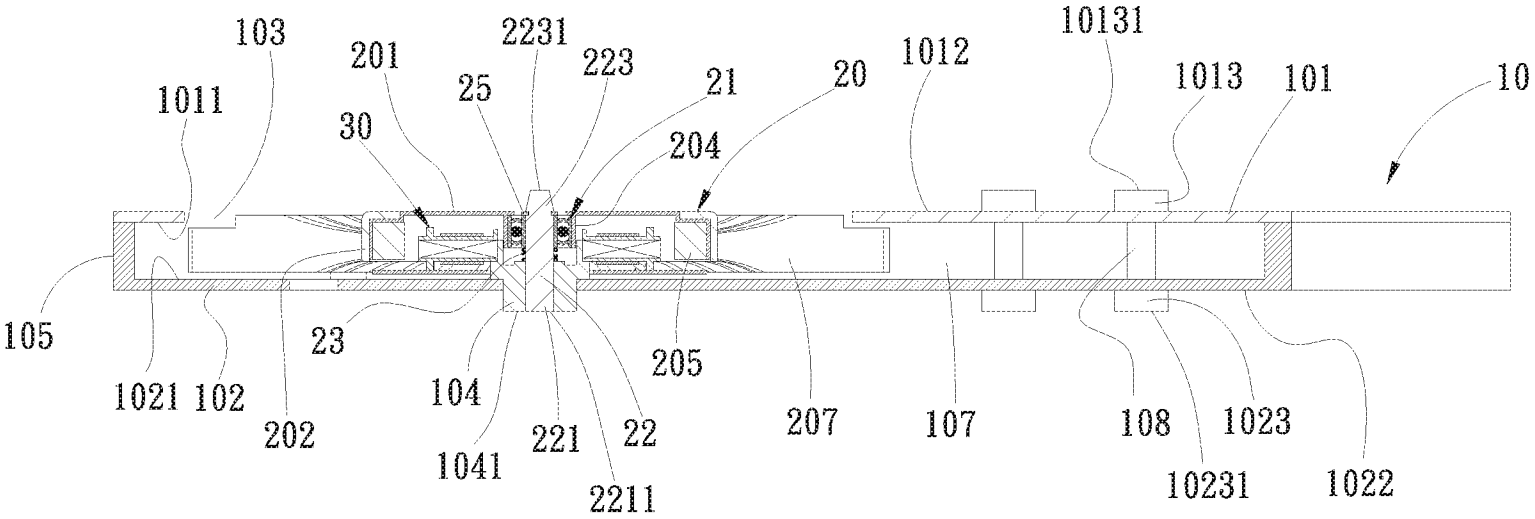
FIG. 4 is a sectional assembled view of the present invention.

Please refer to FIGS. 1 to 4. FIG. 1 is a perspective exploded view of the present invention. FIG. 2 is a partially exploded view of the present invention. FIG. 3 is a perspective assembled view of the present invention. FIG. 4 is a sectional assembled view of the present invention. The present invention includes a fan frame 10, a fan impeller 20 received in the fan frame 10 and a stator assembly 30 received in the fan frame 10. The fan frame 10 has an upper case 101 and a lower case 102. The upper case 101 has a wind entrance 103. The lower case 102 has a connection seat 104. A sidewall 105 and a lateral wind exit 106 are defined between the upper case 101 and the lower case 102. As shown in the drawings, the sidewall 105 is, but not limited to, disposed along a periphery of the lower case 102 and perpendicularly extends to connect with the upper case 101. In a modified embodiment, the sidewall 105 is disposed along a periphery of the upper case 101 and perpendicularly extends to connect with the lower case 102.

A flow way 107 is defined between the fan impeller 20 and the lateral wind exit 106. At least one support column 108 is disposed in the flow way 107. The support column 108 has two ends respectively abutting against and connecting with an inner face 1011 of the upper case 101 and an inner face 1021 of the lower case 102. In addition, an upper case boss 1013 and a lower case boss 1023 are respectively disposed on an outer face 1012 of the upper case 101 and an outer face 1022 of the lower case 102 corresponding to two ends of the support column 108. The upper case boss 1013 has a top connection face 10131. The lower case boss 1023 has a bottom connection face 10231. As shown in the drawings, there are two support columns 108 respectively corresponding to an upper case boss 1013 and a lower case boss 1023.

The fan impeller 20 such as a centrifugal fan impeller communicates with the lateral wind exit 106 through the flow way 107. The fan impeller 20 has a top wall 201 and an annular wall 202. The top wall 201 has a central perforation 203 corresponding to the wind entrance 103. A fan impeller bearing cup 204 downward protrudes from the top wall 201. A stop member 2031 is disposed in the central perforation 203. The stop member 2031 horizontally extends from the top wall 201 toward a center of the central perforation 203. Multiple blades 207 are annularly disposed on an outer circumference of the annular wall 202. A magnetic member 205 such as an annular magnet is disposed on an inner circumference of the annular wall 202.

A roller bearing 21 is received in the bearing cup 204 of the fan impeller to abut against the stop member 2031. The roller bearing 21 includes an outer circular seat 211, an inner circular seat 212 and multiple rolling bodies 213 (such as balls, needles or rollers). By means of a retainer member 241 (such as a retainer support), the rolling bodies 213 are uniformly distributed between the outer circular seat 211 and the inner circular seat 212. The inner circular seat 212 defines a fitting hole 215. The outer circular seat 211 is in contact with and secured in the fan impeller bearing cup 204 by means of such as press fit.

A support shaft 22 has a fixed end 221 connected with the connection seat 104 and an extension end 222 extending through the fitting hole 215 of the roller bearing 21 and the central perforation 203 of the fan impeller 20 to protrude (extend) from the wind entrance 103 so as to support the fan impeller 20 and the roller bearing 21 disposed in the fan frame 10. The extension end 222 of the support shaft 22 is formed with a protrusion section 223 protruding from the top wall 201 of the fan impeller 20 and the upper case 101 of the fan frame 10. The protrusion section 223 has an abutment face 2231 flush with the top connection face 10131 of the upper case boss 1013. Moreover, the extension end 223 of the support shaft 22 is formed with a neck section 224 connected with a restriction member 25 (such as a C-shaped retainer ring or an O-shaped retainer ring). The neck section 224 and the restriction member 25 correspond to the central perforation 203 of the top wall 201 of the fan impeller 20 and the restriction member 25 is positioned above the roller bearing 21.

A thrust member 6 is selectively fitted on the support shaft 2 and positioned between the roller bearing 21 and the connection seat 104. The thrust member 23 has a first end 231 in contact with the roller bearing 21 and a second end 232 in contact with the connection seat 104. The thrust member 23 is such as a spring positioned under the roller bearing 21 to elastically abut against the roller bearing 21. The thrust member 23 serves to bear the axial action force of the roller bearing 21 in operation. Also, the thrust member 23 and the restriction member 25 positioned above the roller bearing 21 together restrict the roller bearing 21 from axially displacing.

The stator assembly 30 is disposed around the connection seat 104 and correspondingly spaced from the magnetic member 205 of the fan impeller 20. The stator assembly 30 includes a circuit board 301 and a silicon steel sheet assembly 302 disposed on the circuit board 301. The silicon steel sheet assembly 302 has multiple stacked silicon steel sheets and a central through hole 303 fitted around the connection seat 104. The silicon steel sheet assembly 302 is sandwiched between an upper insulation support 304 and a lower insulation support 305. Multiple windings 306 are wound on the silicon steel sheet assembly 302 and the upper and lower insulation supports 304, 305.

It should be noted that the connection seat 104 has a connection seat lower end face 1041. The fixed end 221 of the support shaft 22 has a support shaft lower end face 2211 flush with the connection seat lower end face 1041. In addition, the connection seat lower end face 1041 and the support shaft lower end face 2211 protrude from the lower case 102 of the fan frame 10 to abut against another external unit. The connection seat lower end face 1041 and the support shaft lower end face 2211 are flush with the bottom connection face 10231 of the lower case boss 1023.

Figure 5A:
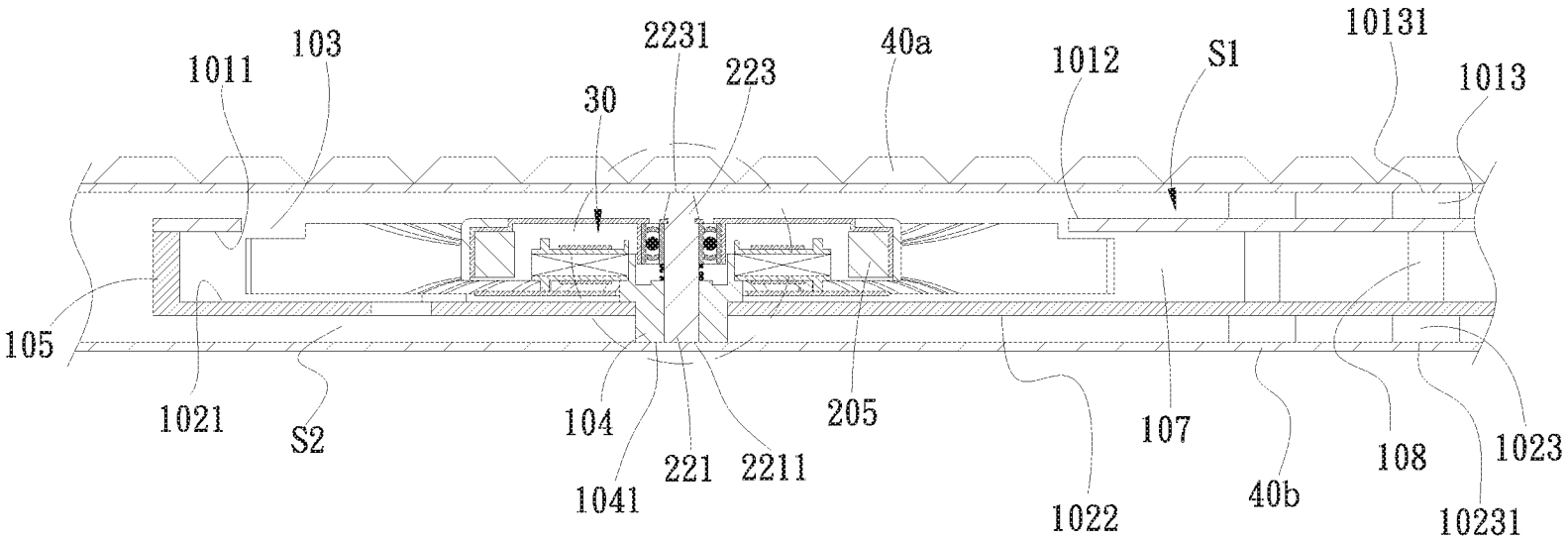
FIG. 5A is a sectional view showing the present invention and the external unit.
Figure 5B:
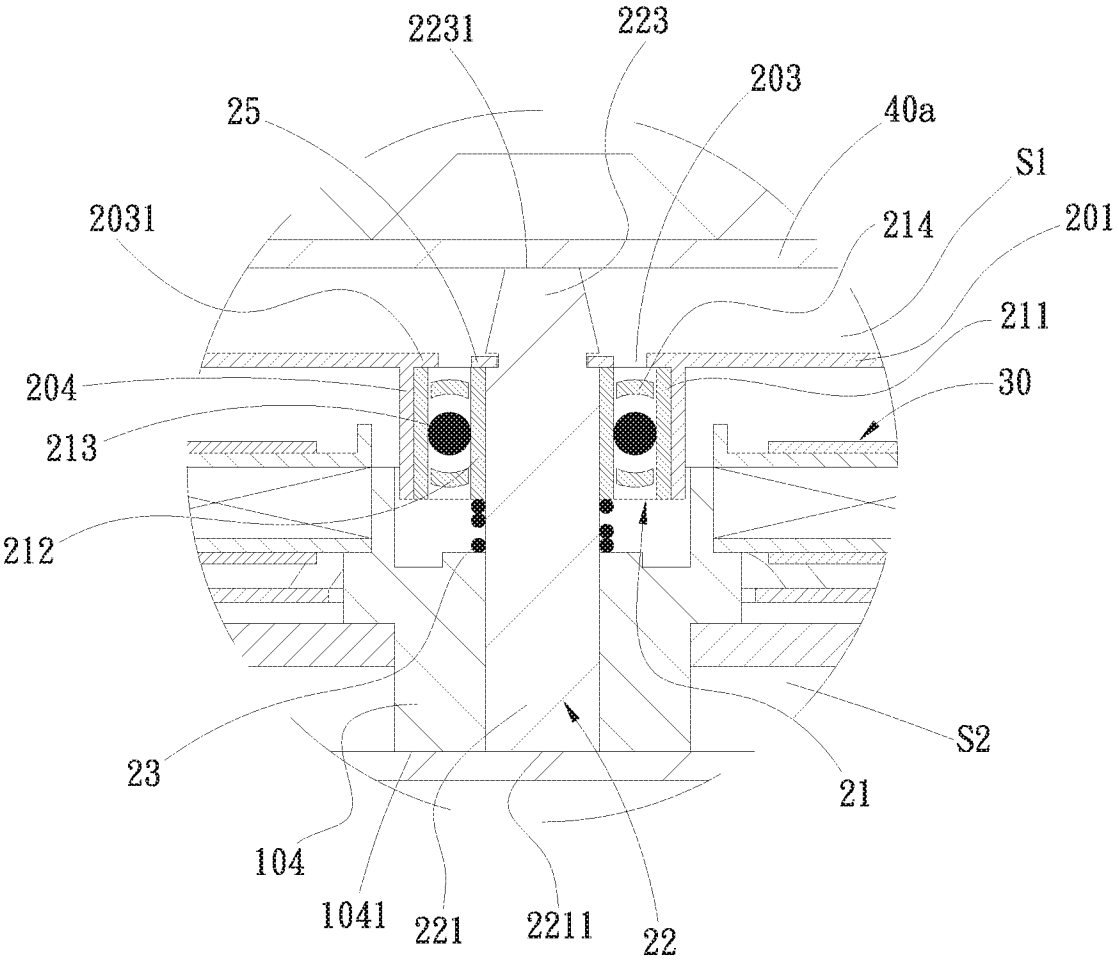
FIG. 5B is an enlarged view of circled area of FIG. 5A.

Please further refer to FIGS. 5A and 5B. FIG. 5A is a sectional view showing the present invention and the external unit. FIG. 5B is an enlarged view of circled area of FIG. 5A. The fan of the present invention is disposed in an electronic device to help in dissipating the heat generated by the internal heat generation components. As shown in the drawing, the electronic device is, but not limited to, a notebook. Alternatively, the electronic device can be a tablet, a cellular phone, a handheld game or any other handheld electronic product. An external unit 40*a* is positioned above the fan frame 10. In this embodiment, the external unit 40*a* is a keyboard. In a modified embodiment, the external unit 40*a* is a touch panel, a touch pad, a device case or a case body. The abutment face 2231 of the protrusion section 223 of the support shaft 22 and the top connection face 10131 of the upper case boss 1013 together bear and connect with the external unit 40*a* to form a first axial space S1 between the external unit 40*a* and the upper case 101 of the fan frame 10.

When the external unit 40*a* is pressed, the external unit 40*a* creates a downward compression force. The abutment face 2231 of the protrusion section 223 of the support shaft 22 and the top connection face 10131 of the upper case boss 1013 bear the compression force of the external unit 40*a*. In addition, the first axial space S1 provides a depression micro-deformation space for the external unit 40*a* in short time. Therefore, the external unit 40*a* is prevented from compressing the fan impeller 20 and/or the flow way 107 in the fan frame 10 so that the fan impeller 20 is protected from being compressed to stop operating and/or the flow way 107 is prevented from being compressed and deformed.

Moreover, the connection seat lower end face 1041 and the support shaft lower end face 2211 and the bottom connection face 10231 abut against another external unit 40*b* disposed under the fan frame 10. In this embodiment, the other external unit 40*b* is a device case. However, in a modified embodiment, the external unit 40*b* is a touch panel, a touch pad or a keyboard. A second axial space S2 is formed between the other external unit 40*b* and the lower case 102 of the fan frame 10. Accordingly, the other external unit 40*b* is prevented from compressing the fan impeller 20 and/or the flow way section 107 in the fan frame 10. Therefore, the fan impeller 20 is free from the compression and is prevented from failing to operate and/or the flow way section 107 is prevented from being compressed and deformed.

According to the above structure, the present invention is truly able to prevent the external units 40*a*, 40*b* from compressing the fan impeller 20 and/or the flow way 107 in the fan frame 10.

The present invention has been described with the above embodiments thereof and it is understood that many changes and modifications in such as the form or layout pattern or practicing step of the above embodiments can be carried out without departing from the scope and the spirit of the invention that is intended to be limited only by the appended claims.

What is claimed is:

1. An anti-press fan structure comprising:

a fan frame having an upper case and a lower case, the upper case having a wind entrance, the lower case having a connection seat;

a fan impeller having a top wall and an annular wall, the top wall having a central perforation corresponding to the wind entrance, a fan impeller bearing cup downward protruding from the top wall, multiple blades being disposed on an outer circumference of the annular wall, a magnetic member being disposed on an inner circumference of the annular wall;

a roller bearing having an outer circular seat, an inner circular seat and a retainer member and multiple rolling bodies disposed between the outer circular seat and the inner circular seat, the outer circular seat being in contact with inner circumference of the fan impeller bearing cup, the inner circular seat defining a fitting hole;

a support shaft having a fixed end connected with the connection seat and an extension end extending through the fitting hole of the roller bearing and the central perforation of the fan impeller to protrude from the wind entrance so as to support the fan impeller and the roller bearing disposed in the fan frame, the extension end being formed with a protrusion section protruding from the top wall of the fan impeller and the upper case of the fan frame, the protrusion section having an abutment face;

a stator assembly disposed around the connection seat and correspondingly spaced from the magnetic member of the fan impeller; and a thrust member fitted on the support shaft and positioned between the roller bearing and the connection seat.

2. The anti-press fan structure as claimed in claim 1, wherein the support shaft is formed with a neck section connected with a restriction member, the restriction member being positioned above the roller bearing, the neck section and the restriction member corresponding to the central perforation of the top wall of the fan impeller.

3. The anti-press fan structure as claimed in claim 1, wherein the thrust member has a first end in contact with the roller bearing and a second end in contact with the connection seat.

4. The anti-press fan structure as claimed in claim 1, wherein the fan frame has a sidewall and a lateral wind exit defined between the upper case and the lower case, a flow way being defined between the fan impeller and the lateral wind exit, the fan impeller being a centrifugal fan impeller in communication with the lateral wind exit through the flow way.

5. The anti-press fan structure as claimed in claim 4, wherein at least one support column is disposed in the flow way, the support column having two ends respectively abutting against and connecting with an inner face of the upper case and an inner face of the lower case, an upper case boss and a lower case boss being respectively disposed on an outer face of the upper case and an outer face of the lower case corresponding to two ends of the support column, the upper case boss having a top connection face flush with the abutment face of the protrusion section of the support shaft, the lower case boss having a bottom connection face, the abutment face of the protrusion section and the top connection face of the upper case boss bearing and connecting with an external unit to form a first axial space between the external unit and the upper case of the fan frame.

6. The anti-press fan structure as claimed in claim 1, wherein the restriction member is a C-shaped retainer ring or an O-shaped retainer ring.

7. The anti-press fan structure as claimed in claim 1, wherein the thrust member is a spring.

8. The anti-press fan structure as claimed in claim 1, wherein the multiple rolling bodies of the roller bearing are selected from a group consisting of balls, needles or rollers.

9. The anti-press fan structure as claimed in claim 1, wherein a stop member is disposed in the central perforation of the top wall, the stop member horizontally extending from the top wall toward a center of the central perforation, the roller bearing abutting against the stop member.

10. The anti-press fan structure as claimed in claim 5, wherein the connection seat has a connection seat lower end face, the fixed end of the support shaft having a support shaft lower end face flush with the connection seat lower end face, the connection seat lower end face and the support shaft lower end face protruding from the lower case of the fan frame in flush with the bottom connection face of the lower case boss, the connection seat lower end face and the support shaft lower end face bearing and connecting with another external unit to form a second axial space between the other external unit and the lower case of the fan frame.

* * * * *